US010935346B2

(12) United States Patent
Franklin

(10) Patent No.: US 10,935,346 B2
(45) Date of Patent: Mar. 2, 2021

(54) FIREARM ASSESSORY CASE AND METHOD OF USE

(71) Applicant: John Franklin, Amarillo, TX (US)

(72) Inventor: John Franklin, Amarillo, TX (US)

( * ) Notice: Subject to any disclaimer, the term of this patent is extended or adjusted under 35 U.S.C. 154(b) by 0 days.

(21) Appl. No.: 16/261,554

(22) Filed: Jan. 29, 2019

(65) Prior Publication Data

US 2019/0234709 A1 Aug. 1, 2019

Related U.S. Application Data

(60) Provisional application No. 62/623,993, filed on Jan. 30, 2018.

(51) Int. Cl.

| | |
|---|---|
| ***F41A 35/02*** | (2006.01) |
| ***F41G 1/38*** | (2006.01) |
| ***F41A 13/02*** | (2006.01) |
| *F41G 1/32* | (2006.01) |

(52) U.S. Cl.
CPC ..... *F41G 1/383* (2013.01); *F41A 13/02* (2013.01); *F41G 1/32* (2013.01)

(58) Field of Classification Search
CPC ..... F41G 1/383; F41G 13/02; F41A 35/02
USPC ..... 42/129, 96
See application file for complete search history.

(56) References Cited

U.S. PATENT DOCUMENTS

| | | | | |
|---|---|---|---|---|
| 2,609,479 | A * | 9/1952 | Loewe | H05B 3/342 219/529 |
| 7,213,360 | B1 * | 5/2007 | Galloway | F41G 1/38 42/96 |
| 8,757,821 | B2 * | 6/2014 | Quinnan | F41G 1/383 359/511 |
| D765,213 | S * | 8/2016 | Seuk | D22/109 |
| 2013/0153450 | A1 * | 6/2013 | Travis | F41C 33/06 206/317 |
| 2016/0069641 | A1 * | 3/2016 | Kortemeier | F41G 1/383 206/316.1 |
| 2018/0347946 | A1 * | 12/2018 | Bridgman, Jr. | F41A 35/02 |

* cited by examiner

*Primary Examiner* — Reginald S Tillman, Jr.
(74) *Attorney, Agent, or Firm* — Shannon Warren

(57) ABSTRACT

A firearm heater system for warming a scope of a firearm. The firearm heater system comprising an upper portion, a lower portion, a pocket portion and an edge portion. The upper portion is attached to the pocket portion. The lower portion is attached to the pocket portion. The edge portion is attached to the pocket portion. The edge portion comprise one or more dial apertures. The one or more dial apertures configured to allow access to portions of the scope. The pocket portion comprise a pocket. The pocket is configured to receive a portion of a hand warmer. The firearm heater system configured to wrap around a portion of the scope and hold a portion of the hand warmer against the scope.

13 Claims, 10 Drawing Sheets

FIREARM ASSESSORY CASE AND METHOD OF USE

CROSS-REFERENCE TO RELATED APPLICATIONS

This application claims benefit to US Patent Application Ser. No. 62/623,993 filed on Jan. 30, 2018.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

Prior art known to the Applicant includes U.S. Pat. Nos. 5,281,792A, 3,742,635A

BRIEF SUMMARY OF THE INVENTION

A firearm heater system for warming a scope of a firearm. Said firearm heater system comprising an upper portion, a lower portion, a pocket portion and an edge portion. Said upper portion is attached to said pocket portion. Said lower portion is attached to said pocket portion. Said edge portion is attached to said pocket portion. Said edge portion comprise one or more dial apertures. Said one or more dial apertures configured to allow access to portions of said scope. Said pocket portion comprise a pocket. Said pocket is configured to receive a portion of a hand warmer. Said firearm heater system configured to wrap around a portion of said scope and hold a portion of said hand warmer against said scope.

Said firearm heater system for warming said scope of said firearm. Said firearm heater system comprising said pocket, a scope wrap portions and said pocket portion. A portion of said scope wrap portions is configured to selectively wrap around a portion of said scope. A portion of said pocket is configured to selectively hold said hand warmer. Said firearm heater system comprises a detached configuration and a fully attached configuration. Said pocket and said hand warmer are configured to align with a battery compartment of said scope.

Said firearm heater system for retaining heat against a portion of said battery compartment of said scope is disclosed. Comprising said firearm heater system comprising said pocket, said scope wrap portions, said pocket portion, one or more batteries and a heater coils. A portion of said scope wrap portions is configured to selectively wrap around a portion of said scope. A portion of said pocket is configured to selectively hold said hand warmer. Said firearm heater system comprises said detached configuration and said fully attached configuration. Said pocket and said hand warmer are configured to align with said battery compartment of said scope. Said one or more batteries is selectively engaged or disengaged to activate said heater coils.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
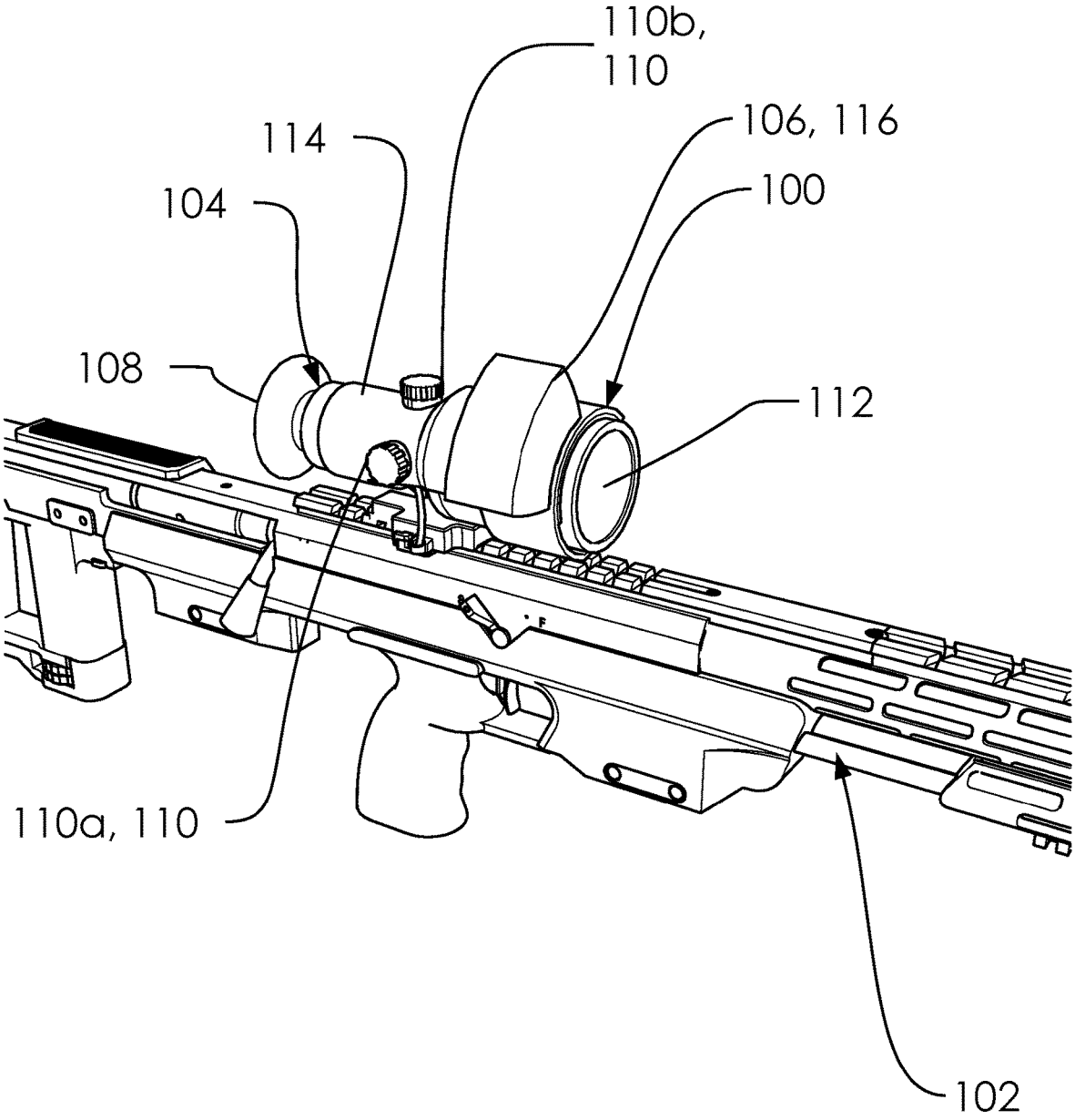
FIG. 1 illustrates a perspective overview of a firearm heater system 100 with a firearm 102.

FIG. 1 illustrates a perspective overview of a firearm heater system 100 with a firearm 102.

In one embodiment, said firearm heater system 100 can comprise one or more dials 110 and an inside surface 504.

In one embodiment, said firearm 102 can comprise said firearm heater system 100 and an outside surface 506.

In one embodiment, a scope 104 can comprise an elevation adjustment knob 110*b*, a windage adjustment knob 110*a*, a third adjustment knob 110*c* and an eyepiece aperture 402.

In one embodiment, said one or more dials 110 can comprise an objective lens 112, a scope sleeve 114 and a DVR system 116.

In one embodiment, said firearm heater system 100 can comprise a system for protecting and maintaining said scope 104 on said firearm 102.

Said firearm heater system 100 can comprise said scope sleeve 114 configured to wrap around a portion of said scope 104 and a DVR case 106 configured to attach to a portion of said scope sleeve 114. Said DVR case 106 can selectively hold a DVR or mini-DVR box (such as said DVR system 116) which can be attached to said scope 104. In one embodiment, the term "DVR" can be a "Digital Video Recorder". In this context, the DVR can collect video recordings captured by said scope 104.

Said scope 104 can comprise a digital night-vision scope used by sportsmen for hunting or marksmanship competitions.

In one embodiment, said scope 104 can require a battery to operate night-vision and DVR capabilities. Such systems are prone to drain batteries quickly, especially in cold weather conditions. Accordingly, sportsmen are prone to drain batteries very quickly when hunting at night in the winter. Said firearm heater system 100 can be configured to overcome this shortcoming by warming said scope 104. Further, in one embodiment, said firearm heater system 100 can store said DVR in said DVR case 106.

In one embodiment, said one or more dials 110 can comprise said windage adjustment knob 110*a*, said elevation adjustment knob 110*b*, and said third adjustment knob 110*c*. In one embodiment, said third adjustment knob 110*c* can comprise an on/off control for laser and battery compartments.

Figure 2:
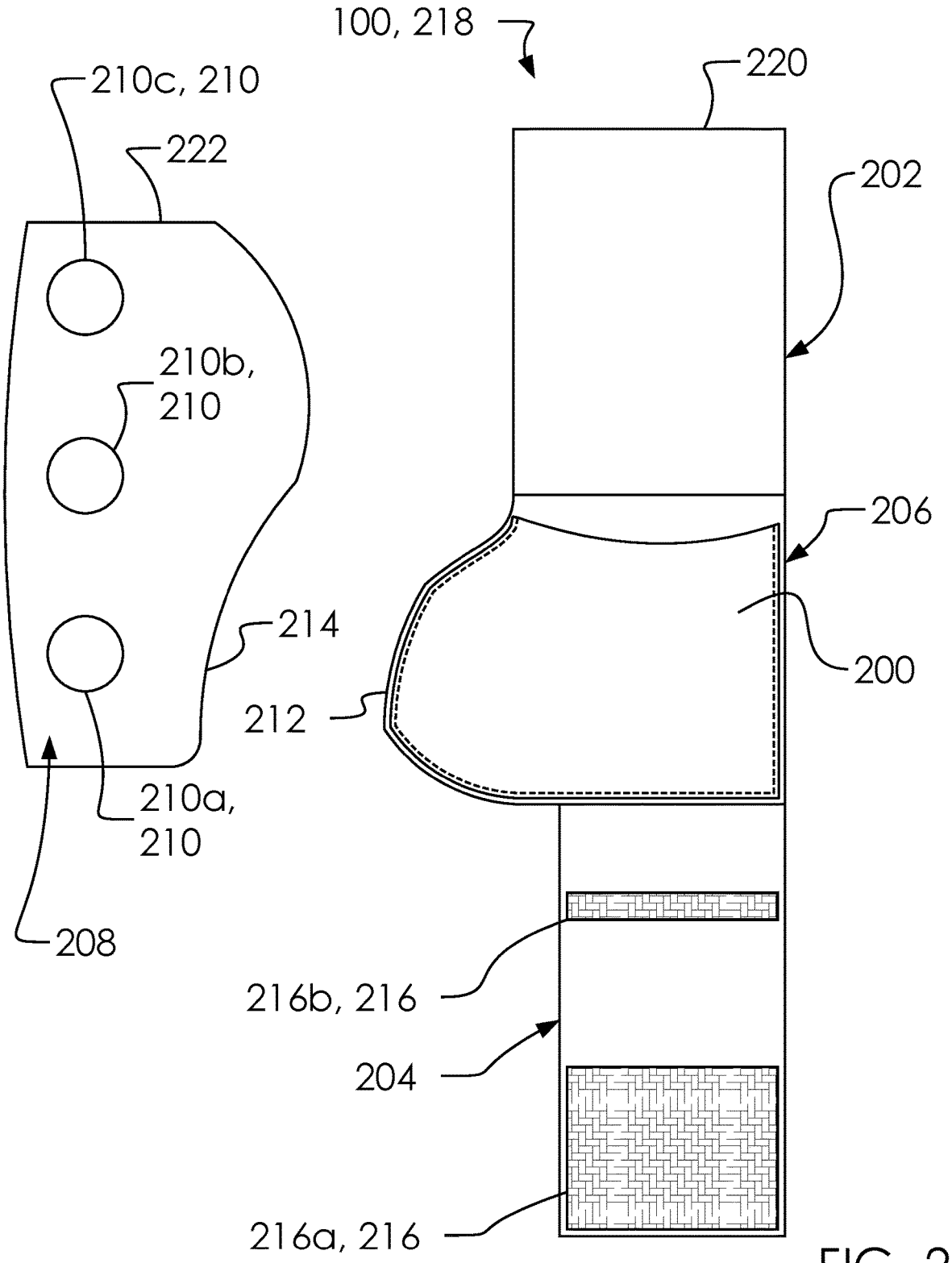
FIG. 2 illustrates an elevated front view of a disassembled configuration 218 of said firearm heater system 100.

FIG. 2 illustrates an elevated front view of a disassembled configuration 218 of said firearm heater system 100.

In one embodiment, said firearm heater system 100 can comprise a pocket 200, an upper portion 202, a lower portion 204, a pocket portion 206, an edge portion 208, one or more dial apertures 210, one or more hook-and-loop fasteners 216, said disassembled configuration 218, an upper edge 220 and an upper edge 222. said upper portion 202 can comprise an attachment bracket 604.

Said one or more dial apertures 210 can comprise a first dial aperture 210*a*, a second dial aperture 210*b* and a third dial aperture 210*c*.

In one embodiment, said edge portion 208 can comprise a second edge 214, a first edge 212, said one or more hook-and-loop fasteners 216, said disassembled configuration 218 and a scope front portion 606. said one or more dial apertures 210 can comprise said one or more dial apertures 210, said first dial aperture 210*a* and said second dial aperture 210*b*. Said one or more hook-and-loop fasteners 216 can comprise a first hook-and-loop fastener 216*a* and a second hook-and-loop fastener 216*b*.

In one embodiment, said pocket 200 can be configured to hold a heating element (see below) against said scope 104. In one embodiment, said firearm heater system 100 can wrap around a portion of said scope 104 with said upper portion 202, said lower portion 204 and said pocket portion 206. In one embodiment, said pocket 200 can be configured to press against a battery in said scope 104.

Figure 3A:
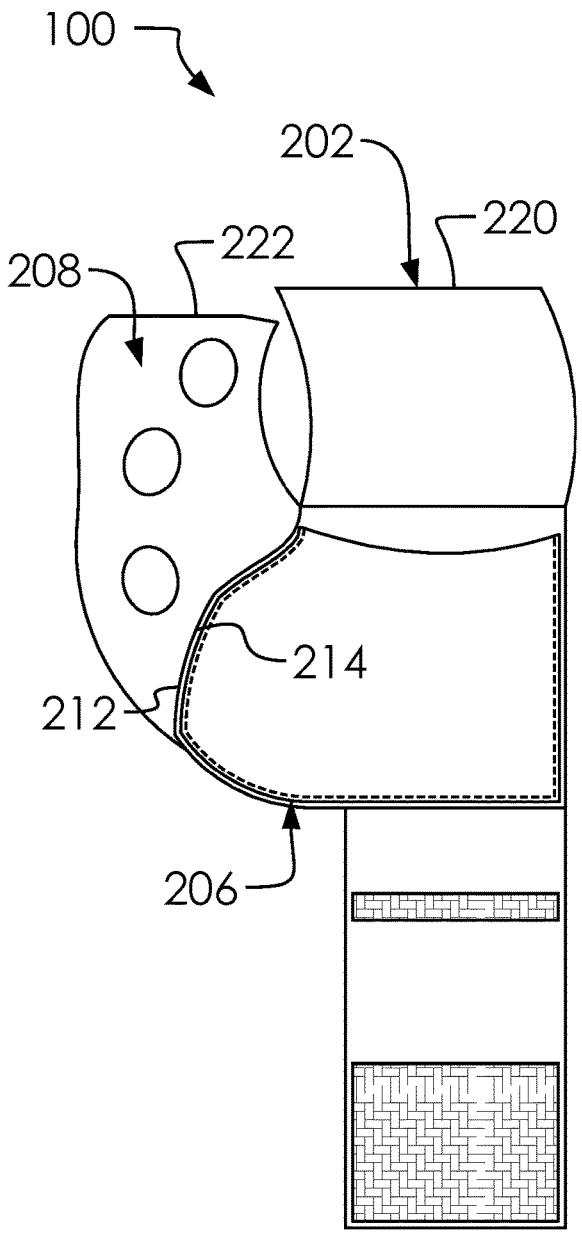
FIGS. 3A and 3B illustrate an inside out configuration 300.
Figure 3B:
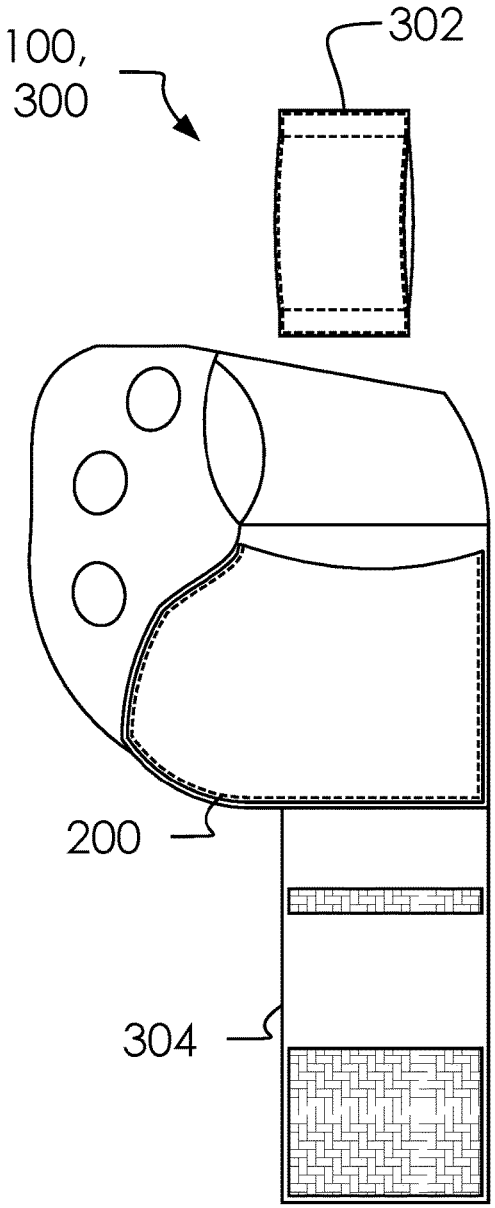

FIGS. 3A and 3B illustrate an inside out configuration 300.

In one embodiment, said firearm heater system 100 can comprise said inside out configuration 300 comprising said upper portion 202 and said pocket portion 206 flipped inside out for assembly. Said pocket portion 206 can be configured to selectively receive a hand warmer 302, as illustrated.

In one embodiment, said hand warmer 302 can comprise a small (mostly disposable) pocket, as is known in the art, which can be held in the hand and produce heat on demand to warm cold hands. They are commonly used in outdoor activities. Other types of warmers are available to provide soothing heat for muscular or joint aches. Depending on the type and the source of heat, hand warmers can last from 30 minutes (recrystallisation) up to 24 hours (platinum catalyst). (Quoting partially from the Wikipedia article on Hand Warmer).

Said firearm heater system 100 can be assembled by: attaching said upper portion 202 to said pocket portion 206, said lower portion 204 to said pocket portion 206, said second edge 214 to said first edge 212, and said upper edge 220 to said upper edge 222, as illustrated.

Said hand warmer 302 can comprise a disposable item used and discarded within said pocket 200 to warm portions of said scope 104.

Figure 4:
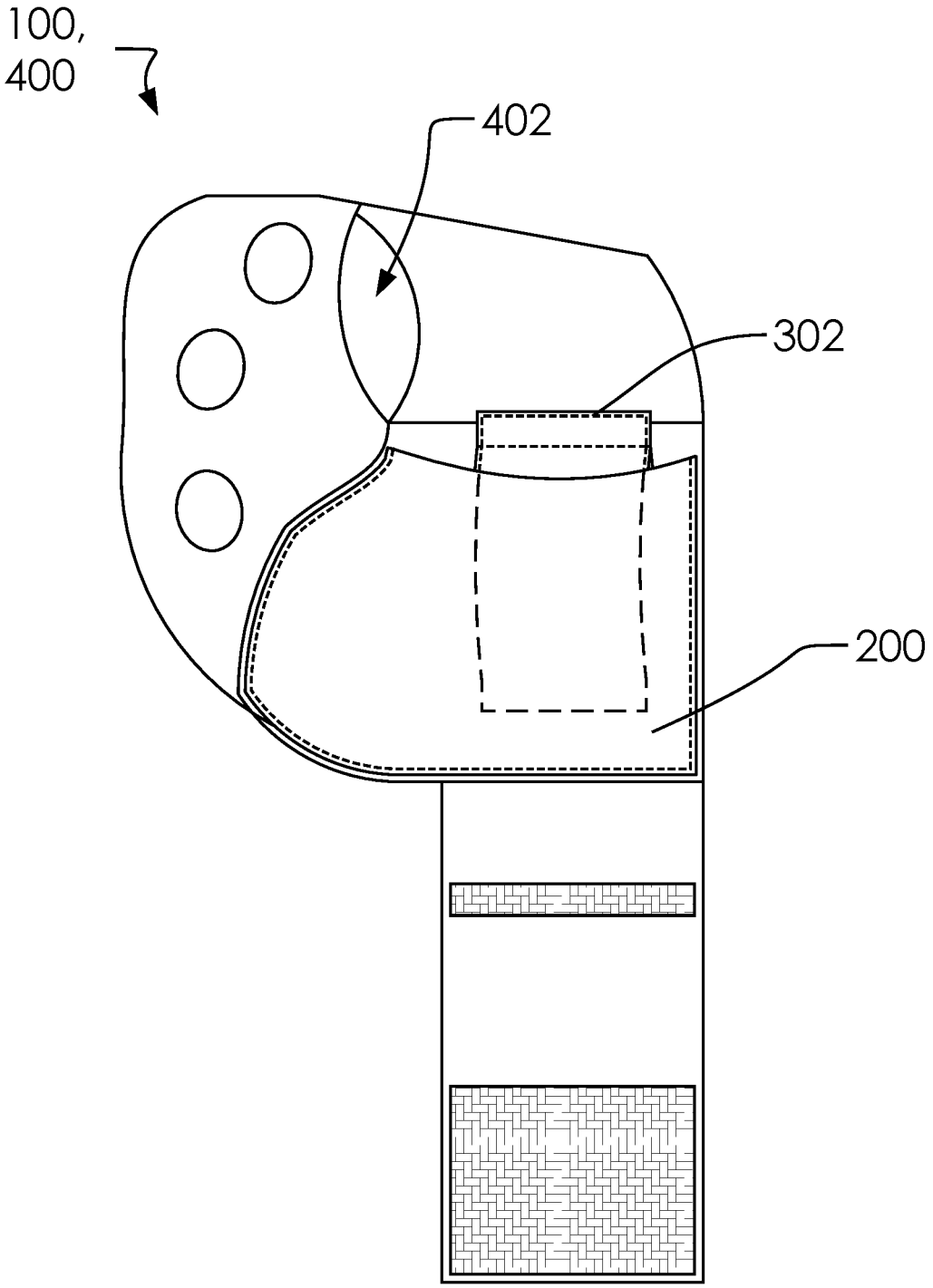
FIG. 4 illustrates an elevated top view of a warmer in pocket configuration 400 of said firearm heater system 100.

FIG. 4 illustrates an elevated top view of a warmer in pocket configuration 400 of said firearm heater system 100.

In one embodiment, said eyepiece aperture 402 can be formed by a gap between said edge portion 208, said upper edge 222, said upper portion 202, and said upper edge 220. Said eyepiece aperture 402 can be adapted to receive a portion of an eyepiece 108 and/or a portion of said scope 104.

Figure 5:
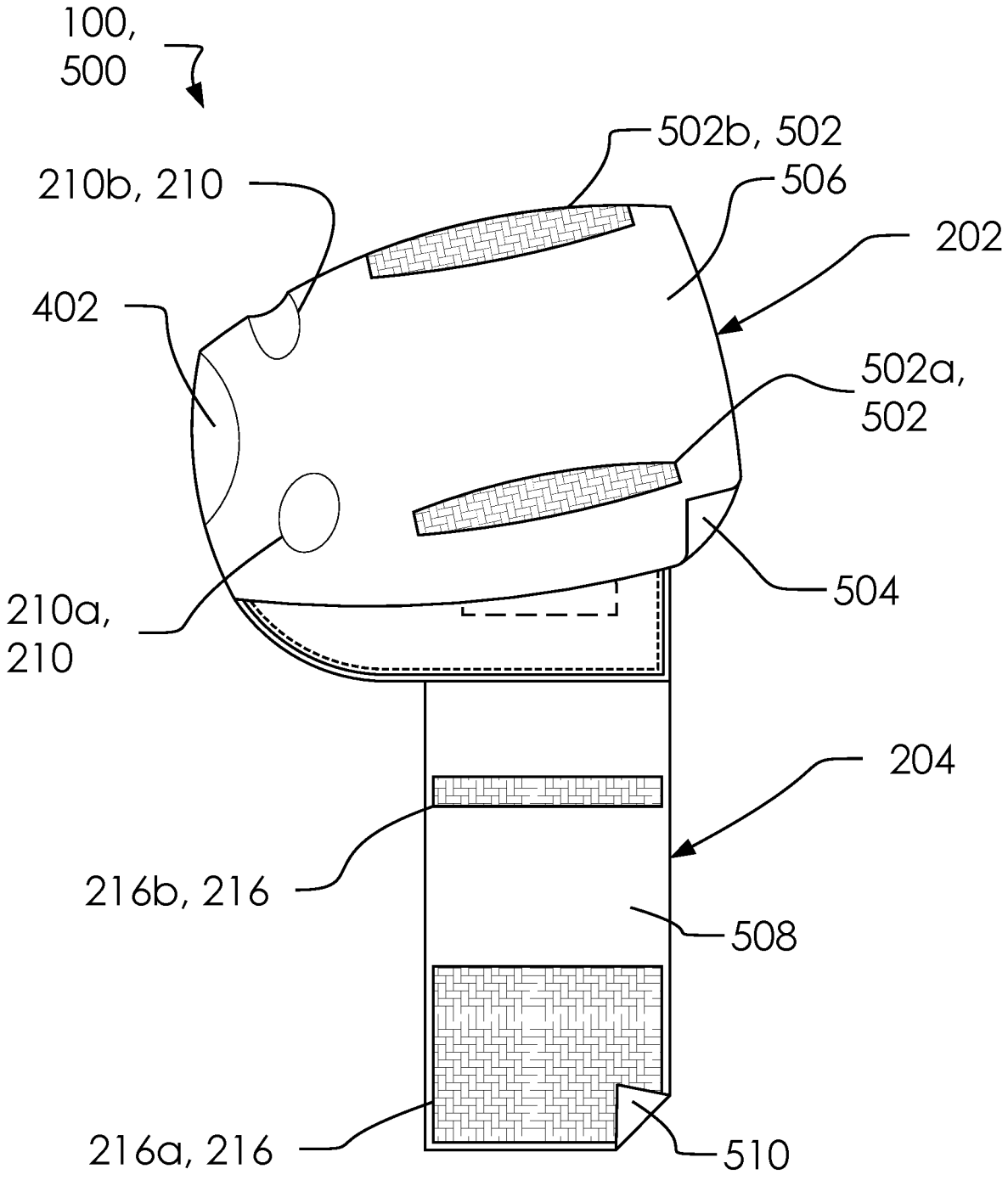
FIG. 5 illustrates an elevated front view of a ready to attach configuration 500 of said firearm heater system 100.

FIG. 5 illustrates an elevated front view of a ready to attach configuration 500 of said firearm heater system 100.

In one embodiment, said firearm heater system 100 can comprise one or more external hook-and-loop fasteners 502. said one or more external hook-and-loop fasteners 502 can comprise a first external hook-and-loop fastener 502*a* and a second external hook-and-loop fastener 502*b*.

In one embodiment, said upper portion 202 can said inside surface 504 and said outside surface 506; and said lower portion 204 can comprise an inside surface 508 and an outside surface 510. Further, said lower portion 204 can comprise said upper edge 220 and said upper edge 222.

In one embodiment, said firearm heater system 100 can be folded into said ready to attach configuration 500 which can enclose said pocket 200 between said upper portion 202, said pocket portion 206 and said lower portion 204.

In one embodiment said one or more external hook-and-loop fasteners 502 can be attached to said outside surface 506 of said upper portion 202. Said one or more hook-and-loop fasteners 216 can be attached to said inside surface 508 of said lower portion 204. In one embodiment, said one or more hook-and-loop fasteners 216 can selectively attach to said one or more external hook-and-loop fasteners 502. Attaching said one or more external hook-and-loop fasteners 502 to said one or more hook-and-loop fasteners 216 can selectively hold said pocket 200 against portions of said scope 104.

Figure 6A:
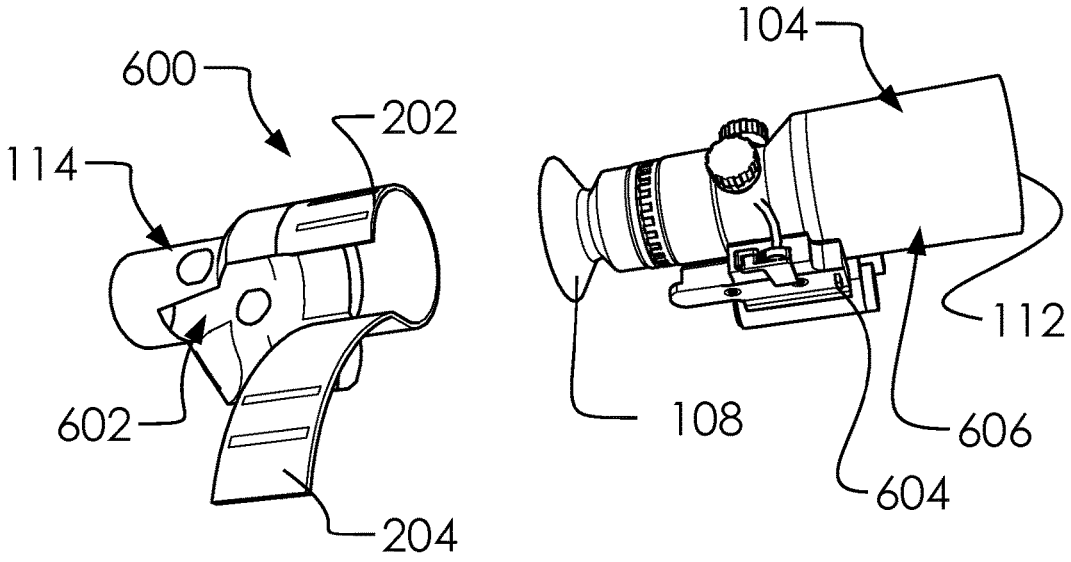
FIGS. 6A and 6B illustrate a perspective front and rear view of a detached configuration 600 of said firearm heater system 100.
Figure 6B:
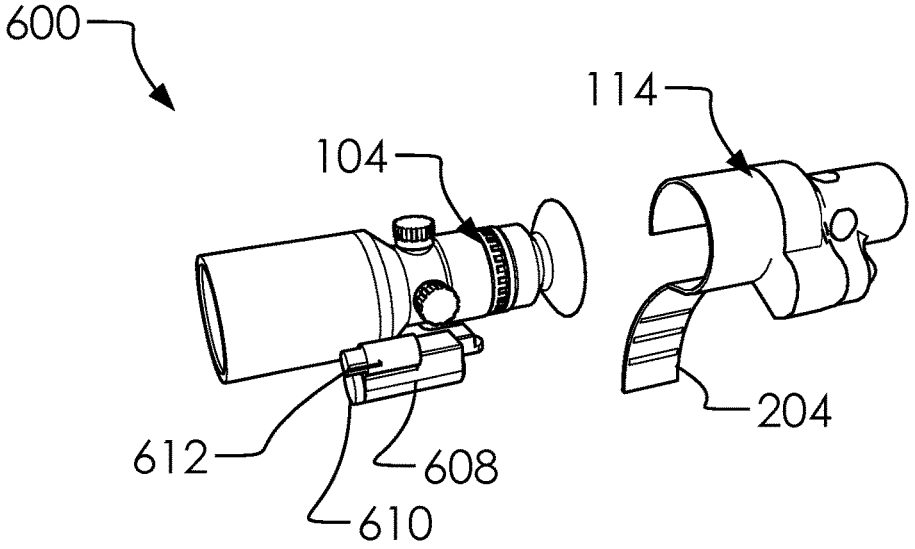
Figure 7A:
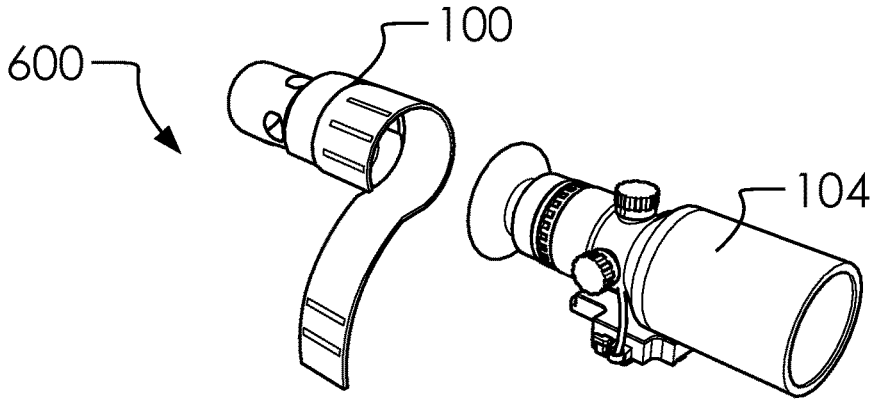
FIGS. 7A, 7B, 7C and 7D illustrate a perspective overview of said detached configuration 600, a first attached configuration 700, a second attached configuration 702 and a fully attached configuration 704, respectively.
Figure 7B:
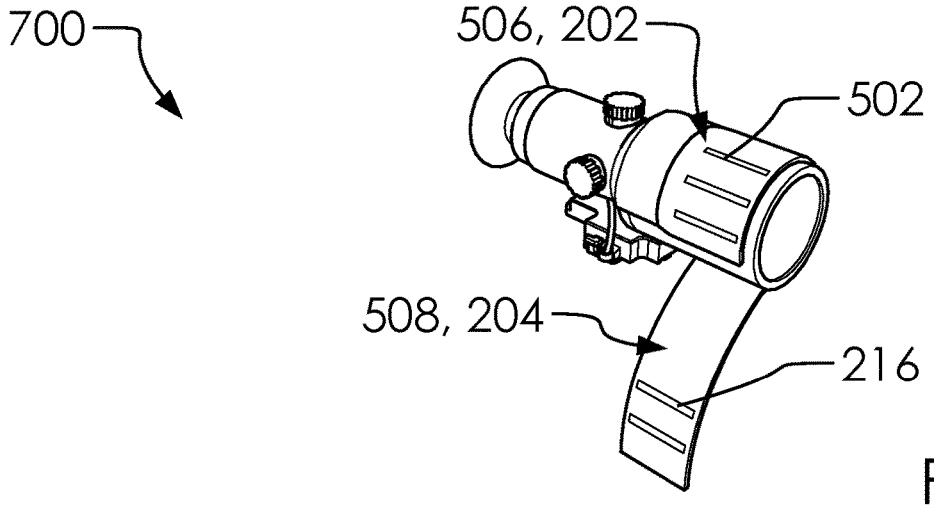
Figure 7C:
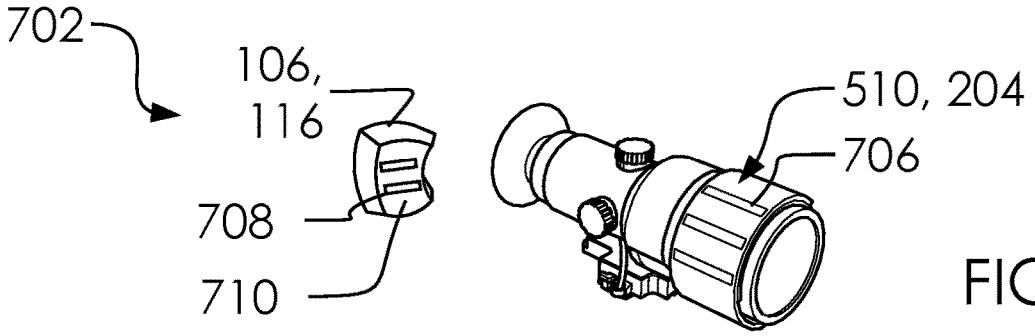
Figure 7D:
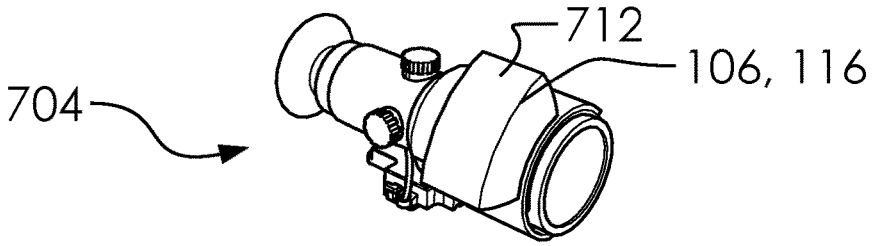

FIGS. 6A and 6B illustrate a perspective front and rear view of a detached configuration 600 of said firearm heater system 100.

In one embodiment, said firearm heater system 100 can comprise a sleeve cavity 602 and a battery compartment 608.

In one embodiment, said scope 104 can comprise a battery cap 610, a system switch 612, a first attached configuration 700, a second attached configuration 702 and a fully attached configuration 704.

In one embodiment, attaching said firearm heater system 100 to said firearm 102 can comprise aligning said sleeve cavity 602 of said firearm heater system 100 with said eyepiece 108 of said firearm 102; sliding said eyepiece 108 and portions of said scope 104 through said sleeve cavity 602 and attaching a portion of said lower portion 204 to said upper portion 202; and securing said lower portion 204 around portions of said scope front portion 606 of said scope 104.

FIGS. 7A, 7B, 7C and 7D illustrate a perspective overview of said detached configuration 600, said first attached configuration 700, said second attached configuration 702 and said fully attached configuration 704, respectively.

In one embodiment, said firearm heater system 100 can comprise an exterior hook-and-loop fasteners 706, a bottom hook-and-loop fasteners 708 and a bottom surface 710.

In one embodiment, said DVR case 106 can comprise a first alternative firearm heater system 800, one or more straps 802 and a first strap 802*a*.

In one embodiment, said outside surface 510 can comprise a top surface 712.

In one embodiment, attaching said firearm heater system 100 to said scope 104 can comprise said detached configuration 600, said first attached configuration 700, said second attached configuration 702 and said fully attached configuration 704.

In one embodiment, said first attached configuration 700 can comprise said firearm heater system 100 substantially wrapped around said scope 104 with said lower portion 204 disengaged from said upper portion 202. Said second attached configuration 702 can comprise said first attached configuration 700 but-for said lower portion 204 attached to a portion of said upper portion 202. Said fully attached configuration 704 can comprise said second attached configuration 702 but-for said DVR case 106 is attached to a portion of said firearm heater system 100.

In one embodiment, said one or more external hook-and-loop fasteners 502 of said outside surface 506 of said upper portion 202 can selectively attach to said one or more hook-and-loop fasteners 216 of said inside surface 508 of said lower portion 204. In one embodiment, said lower portion 204 can wrap around a portion of said objective lens 112 and secure said firearm heater system 100 to said scope 104.

In one embodiment, said DVR case 106 can selectively wrap around said DVR system 116 and provide security and heat retention thereto. In one embodiment, said DVR system 116 can selectively attach to said exterior hook-and-loop fasteners 706 of said outside surface 510 of said lower portion 204 with said bottom hook-and-loop fasteners 708 of said bottom surface 710 of said DVR system 116.

In one embodiment, said DVR case 106 can be held out of the way and securely in said DVR system 116 as illustrated and described herein.

Figure 8:
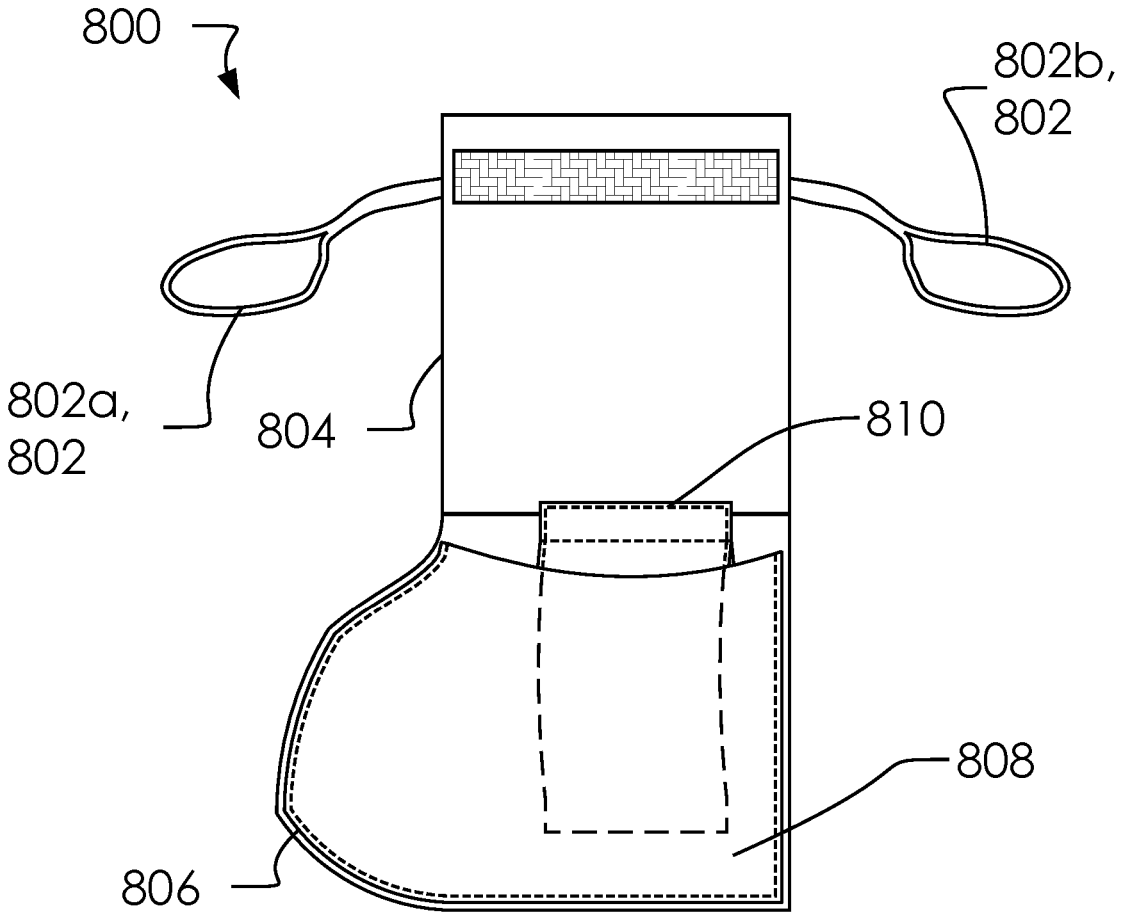
FIG. 8 illustrates an elevated front view of a first alternative firearm heater system 800.

FIG. 8 illustrates an elevated front view of said first alternative firearm heater system 800.

In one embodiment, said first alternative firearm heater system 800 can comprise a second strap 802*b*, an upper portion 804, a warmer 810 and an attached configuration 900.

In one embodiment, said one or more straps 802 can comprise a lower portion 806 and a pocket 808.

In one embodiment, said lower portion 806 can comprise a button 902 and a second alternative firearm heater system 1000.

In one embodiment, said first alternative firearm heater system 800 can comprise said firearm heater system 100 but-for a lack of said eyepiece aperture 402 and said one or more dial apertures 210. In one embodiment, said first alternative firearm heater system 800 can further comprise said one or more straps 802, as illustrated.

Figure 9A:
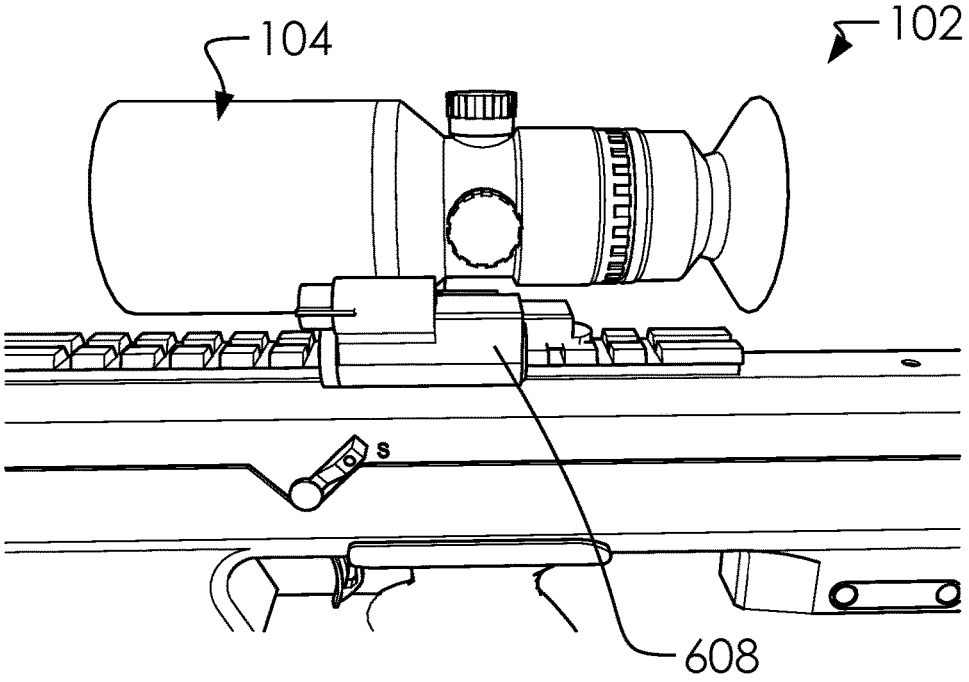
FIGS. 9A and 9B illustrate a perspective frontside view of said firearm 102, and said firearm 102 in an attached configuration 900.
Figure 9B:
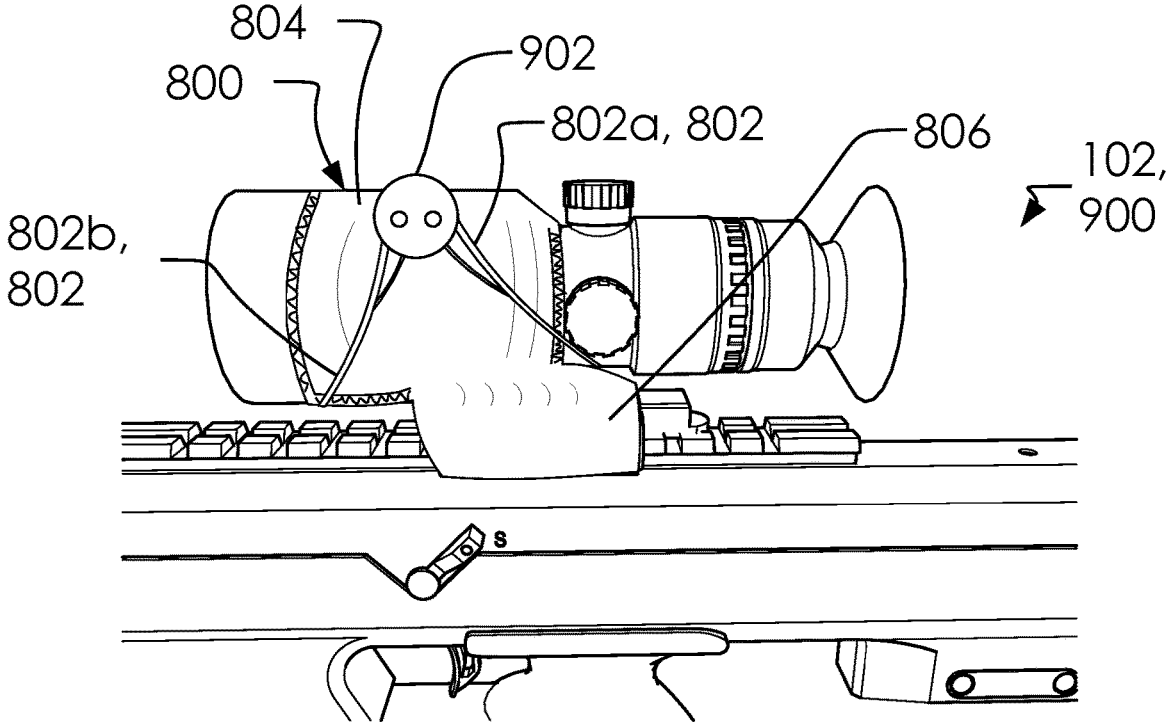

FIGS. 9A and 9B illustrate a perspective frontside view of said firearm 102, and said firearm 102 in said attached configuration 900.

In one embodiment, said first alternative firearm heater system 800 can comprise one or more batteries 1002 and a heater coils 1004.

In one embodiment, said first alternative firearm heater system 800 can wrap around portions of said scope 104. As with said firearm heater system 100, said first alternative firearm heater system 800 can be configured to press said pocket 808 and said warmer 810 into a portion of said battery compartment 608. In one embodiment, said first alternative firearm heater system 800 can align said lower portion 806 with said battery compartment 608.

In one embodiment, said upper portion 804 can wrap around said scope 104 and said one or more straps 802 can wrap around and hook around said button 902, as illustrated. In one embodiment, said one or more straps 802 can comprise elastic materials configured to stretch and firmly hold said first alternative firearm heater system 800 around said scope 104.

Figure 10:
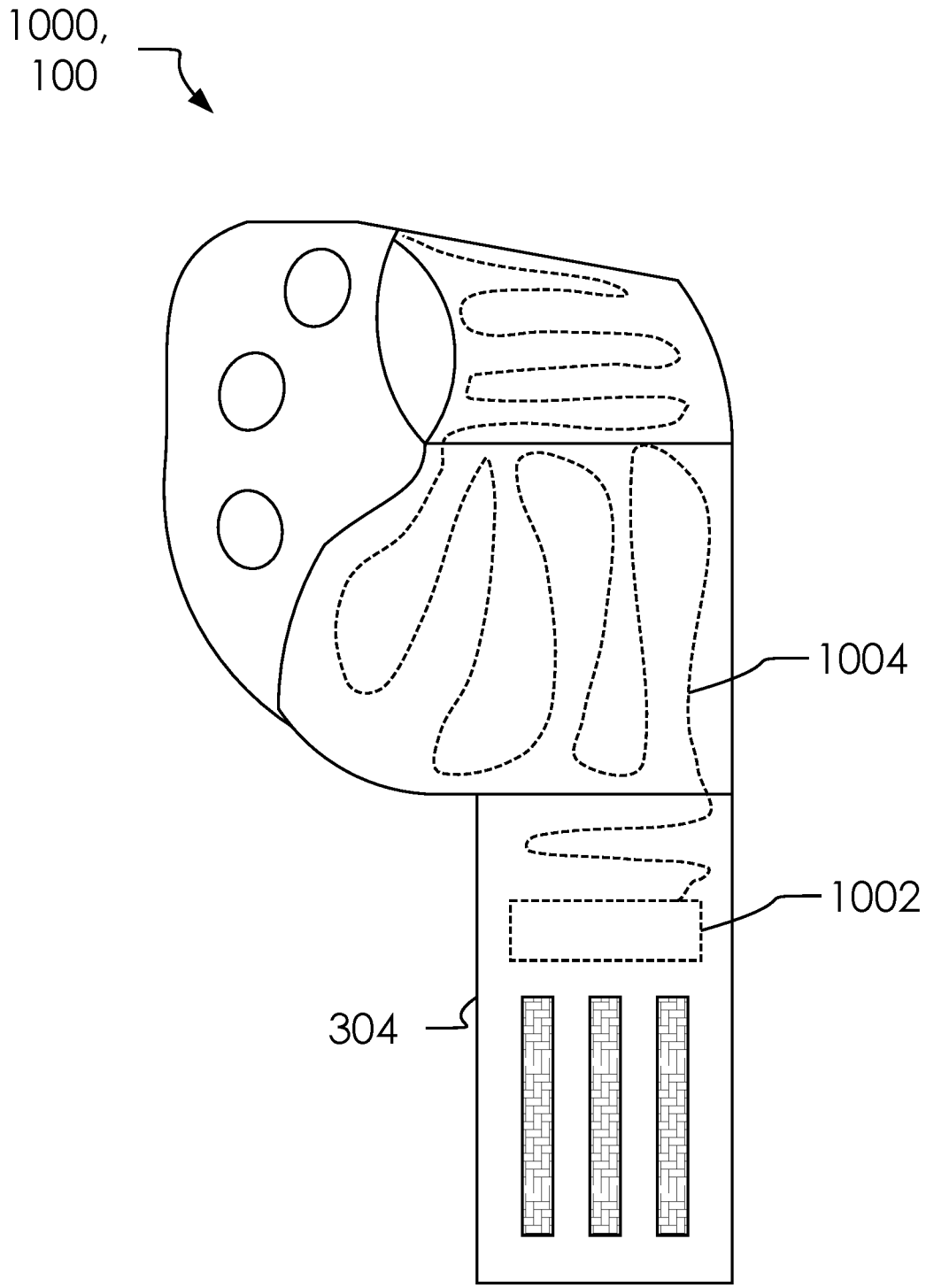
FIG. 10 illustrates an elevated front view of a second alternative firearm heater system 1000.

FIG. 10 illustrates an elevated front view of said second alternative firearm heater system 1000.

In one embodiment, said second alternative firearm heater system 1000 can comprise a scope wrap portions 304, said one or more batteries 1002 and said heater coils 1004. Said firearm heater system 100 can be configured with said one or more batteries 1002 and said heater coils 1004 to form said second alternative firearm heater system 1000. Said one or more batteries 1002 can be engaged or disengaged to activate said heater coils 1004, as is known in the art. Otherwise, said second alternative firearm heater system 1000 can be configured to attach to said firearm 102 in a similar manner as said firearm heater system 100.

The following sentences are generated from the claims and represent at least one embodiment of the current disclosure: said firearm heater system 100 for warming said scope 104 of said firearm 102. Said firearm heater system 100 comprising said upper portion 202, said lower portion 204, said pocket portion 206 and said edge portion 208. Said upper portion 202 is attached to said pocket portion 206. Said lower portion 204 is attached to said pocket portion 206. Said edge portion 208 is attached to said pocket portion 206. Said edge portion 208 comprise said one or more dial apertures 210. Said one or more dial apertures 210 configured to allow access to portions of said scope 104. Said pocket portion 206 comprise said pocket 200. Said pocket 200 is configured to receive a portion of said hand warmer 302. Said firearm heater system 100 configured to wrap around a portion of said scope 104 and hold a portion of said hand warmer 302 against said scope 104.

In one embodiment, said firearm heater system 100 comprising said pocket 200, said scope wrap portions 304 and said pocket portion 206. A portion of said scope wrap portions 304 is configured to selectively wrap around a portion of said scope 104. A portion of said pocket 200 is configured to selectively hold said hand warmer 302. Said firearm heater system 100 comprises said detached configuration 600 and said fully attached configuration 704. Said pocket 200 and said hand warmer 302 are configured to align with said battery compartment 608 of said scope 104.

In one embodiment, said scope wrap portions 304 comprises said upper portion 202, said lower portion 204, said pocket portion 206, and said edge portion 208. Said upper portion 202 is attached to said pocket portion 206. Said lower portion 204 is attached to said pocket portion 206. Said edge portion 208 is attached to said pocket portion 206.

In one embodiment, said firearm heater system 100 further comprises said DVR system 116. Said DVR case 106 is configured to selectively attach said DVR case 106 to said firearm heater system 100. Said DVR system 116 comprises a detachable portion of said scope wrap portions 304.

In one embodiment, said firearm heater system 100 comprises said first attached configuration 700. Said first attached configuration 700 comprises said firearm heater system 100 substantially wrapped around said scope 104 with said lower portion 204 disengaged from said upper portion 202.

In one embodiment, said second attached configuration 702 comprises said first attached configuration 700 but-for said lower portion 204 is attached to a portion of said upper portion 202.

In one embodiment, said fully attached configuration 704 comprises said second attached configuration 702 but-for said DVR case 106 is attached to a portion of said firearm heater system 100.

In one embodiment, said DVR case 106 selectively wraps around said DVR system 116 and provides security and heat retention thereto.

In one embodiment, said DVR system 116 selectively attaches to said exterior hook-and-loop fasteners 706 of said outside surface 510 of said lower portion 204 with said bottom hook-and-loop fasteners 708 of said bottom surface 710 of said DVR system 116. Said DVR case 106 can be held out of the way and securely in said DVR system 116.

In one embodiment, said lower portion 204 selectively wraps around a portion of said objective lens 112 and selectively secures said firearm heater system 100 to said scope 104.

In one embodiment, said one or more external hook-and-loop fasteners 502 of said outside surface 506 of said upper portion 202 selectively attach to said one or more hook-and-loop fasteners 216 of said inside surface 508 of said lower portion 204.

In one embodiment, said edge portion 208 comprise said one or more dial apertures 210.

In one embodiment, said pocket portion 206 comprise said pocket 200.

In one embodiment, said one or more dial apertures 210 are configured to allow said one or more dials 110 to pass through a portion of said scope wrap portions 304. Said one or more dials 110 comprise controls for said scope 104.

In one embodiment, said firearm heater system 100 comprising said pocket 200, said scope wrap portions 304, said pocket portion 206, said one or more batteries 1002 and said heater coils 1004. A portion of said scope wrap portions 304 is configured to selectively wrap around a portion of said scope 104. A portion of said pocket 200 is configured to selectively hold said hand warmer 302. Said firearm heater system 100 comprises said detached configuration 600 and said fully attached configuration 704. Said pocket 200 and said hand warmer 302 are configured to align with said battery compartment 608 of said scope 104. Said one or more batteries 1002 is selectively engaged or disengaged to activate said heater coils 1004.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A firearm heater system for warming a scope of a firearm, wherein: said firearm heater system comprising an upper portion, a lower portion, a pocket portion and an edge portion; said upper portion is attached to said pocket portion; said lower portion is attached to said pocket portion; said edge portion is attached to said pocket portion; said edge portion comprise one or more scope control apertures; said one or more scope control apertures configured to allow access to portions of said scope; said pocket portion comprise a pocket; said pocket is configured to receive a portion of a hand warmer; and said firearm heater system configured to wrap around a portion of said scope and hold a portion of said hand warmer against said scope.

2. A firearm heater system for warming a scope of a firearm, wherein:

said firearm heater system comprising a pocket, a scope wrap portions and a pocket portion;

a portion of said scope wrap portions are configured to selectively wrap around a portion of said scope;

a portion of said pocket is configured to selectively hold a hand warmer;

said firearm heater system comprises a detached configuration and a fully attached configuration;

said pocket and said hand warmer are configured to align with a battery compartment of said scope;

said scope wrap portions comprises an upper portion, a lower portion, said pocket portion, and an edge portion;

said upper portion is attached to said pocket portion;

said lower portion is attached to said pocket portion;

said edge portion is attached to said pocket portion;

said firearm heater system further comprises a DVR system;

a DVR case is configured to selectively attach said DVR case to said firearm heater system; and said DVR system comprises a detachable portion of said scope wrap portions.

3. The firearm heater system from claim 2, wherein:

said firearm heater system comprises a first attached configuration; and said first attached configuration comprises said firearm heater system substantially wrapped around said scope with said lower portion disengaged from said upper portion.

4. The firearm heater system from claim 3, wherein:

a second attached configuration comprises said first attached configuration but-for said lower portion is attached to a portion of said upper portion.

5. The firearm heater system from claim 4, wherein:

said fully attached configuration comprises said second attached configuration but-for said DVR case is attached to a portion of said firearm heater system.

6. The firearm heater system from claim 5, wherein:

said DVR case selectively wraps around said DVR system and provides security and heat retention thereto.

7. The firearm heater system from claim 6, wherein:

said DVR system selectively attaches to an exterior hook-and-loop fasteners of an outside surface of said lower portion with a bottom hook-and-loop fasteners of a bottom surface of said DVR system; and said DVR case can be held out of the way and securely in said DVR system.

8. The firearm heater system from claim 5, wherein: said lower portion selectively wraps around a portion of an objective lens and selectively secures said firearm heater system to said scope.

9. The firearm heater system from claim 5, wherein: one or more external hook-and-loop fasteners of an outside surface of said upper portion selectively attach to one or more hook-and-loop fasteners of an inside surface of said lower portion.

10. The firearm heater system from claim 2, wherein: said edge portion comprise one or more scope control apertures.

11. The firearm heater system from claim 10, wherein: said pocket portion comprise said pocket.

12. The firearm heater system from claim 10, wherein: said one or more scope control apertures are configured to avow one or more scope controls to pass through a portion of said scope wrap portions; and said one or more scope controls comprise controls for said scope.

13. A firearm heater system for warming a scope of a firearm, wherein: said firearm heater system comprising a pocket, a scope wrap portions and a pocket portion; a portion of said scope wrap portions are configured to selectively wrap around a portion of said scope; a portion of said pocket is configured to selectively hold a hand warmer; said firearm heater system comprises a detached configuration and a fully attached configuration; said pocket and said hand warmer are configured to align with a battery compartment of said scope; said scope wrap portions comprises an upper portion, a lower portion, said pocket portion, and an edge portion; said upper portion is attached to said pocket portion; said lower portion is attached to said pocket portion; said edge portion is attached to said pocket portion; and said edge portion comprise one or more scope control apertures.

* * * * *